United States Patent [19]

Miller

[11] 4,296,297

[45] Oct. 20, 1981

[54] DRIVE ARRANGEMENT FOR MICROWAVE OVEN MODE STIRRER

[75] Inventor: Matthew S. Miller, Louisville, Ky.

[73] Assignee: General Electric Company, Louisville, Ky.

[21] Appl. No.: 106,649

[22] Filed: Dec. 26, 1979

[51] Int. Cl.[3] ..... H05B 6/74

[52] U.S. Cl. ..... 219/10.55 F; 219/10.55 R

[58] Field of Search ..... 219/10.55 F, 10.55 R, 219/10.55 B

[56] References Cited

U.S. PATENT DOCUMENTS

| | | | |
|---|---|---|---|
| 2,813,185 | 11/1957 | Smith | 219/10.55 F |
| 3,471,671 | 10/1969 | Puschner | 219/10.55 R |
| 3,783,219 | 1/1974 | Tateda | 219/10.55 R |
| 3,965,325 | 6/1976 | Hirai | 219/10.55 F X |
| 3,991,295 | 11/1976 | Akiyoshi | 219/10.55 F |
| 4,019,010 | 4/1977 | Tanaka et al. | 219/10.55 F |
| 4,144,436 | 3/1979 | Hauck | 219/10.55 F |
| 4,144,437 | 3/1979 | Ehlers | 219/10.55 F |

FOREIGN PATENT DOCUMENTS

| | | | |
|---|---|---|---|
| 54-2531 | 1/1979 | Japan | 219/10.55 F |

*Primary Examiner*—Arthur T. Grimley

*Attorney, Agent, or Firm*—Bernard J. Lacomis; Radford M. Reams

[57] ABSTRACT

A mode stirrer drive assembly in which the mode stirrer blades are rotated by the force of air against a drive fan. The blades of the drive fan are curved to form convex surfaces which are arranged to face into the flow of air across the drive fan. During rotation an upward force is thereby exerted on the assembly which lifts the assembly off of a thrust bearing and thereby reduces frictional losses and noise and improves performance and efficiency.

6 Claims, 6 Drawing Figures

DRIVE ARRANGEMENT FOR MICROWAVE OVEN MODE STIRRER

CROSS REFERENCE TO RELATED APPLICATION

This application is related to a concurrently filed application entitled "Mode Stirrer Arrangement for a Microwave Oven" in the name of Bobby J. Bale, application Ser. No. 107,003, and to a concurrently filed application entitled "Mode Stirrer Arrangement for a Microwave Oven" in the name of Royce W. Hunt, Ser. No. 107,004.

BACKGROUND OF THE INVENTION

1. Field of the Invention

This application is directed to microwave ovens and to mode stirrers for use in microwave ovens and, more particularly, to a novel drive arrangement for rotating a mode stirrer device in the path of microwave energy entering the cooking cavity of a microwave oven.

2. Description of the Prior Art

One well known problem associated with conventional microwave ovens concerns the uneven distribution of microwave energy within the cooking cavity. The result of such unevenness has been the creation of "hot spots" and "cold spots" at different finite areas of the oven. For many types of foods, cooking results are unsatisfactory under such conditions because some portions of the food may be completely cooked while others are barely warmed.

One explanation for the non-uniform cooking pattern is that electromagnetic standing wave patterns, known as "modes," are set up within the cooking cavity. When such a standing wave pattern is set up, the intensities of the electric and magnetic fields vary greatly with position. The precise configuration of the standing wave or mode pattern during a cooking cycle is dependent on a multitude of factors, among which are the characteristics of the microwave energy source, the dimensions and makeup of the cavity, and the loading effect of different types and quantities of food which are placed in the cooking cavity.

In an effort to alleviate the problem of non-uniform energy distribution, a great many approaches have been tried with varying degrees of success. The most common approach involves the use of a so-called "mode-stirrer" or mode changer which typically resembles a fan having metal blades. The mode stirrer rotates and may be placed either within the cooking cavity itself (usually protected by a cover constructed of a material transparent to microwave ovens) or, to conserve space within the cooking cavity, may be mounted within a recess formed in one of the cooking cavity walls, normally the top.

The most common method of turning the blades of such mode stirrers is to attach the blades to a shaft which extends into the microwave oven cooking cavity through the top wall of the enclosure. An electric motor is coupled to the end of the shaft opposite the blades to impart a rotary motion thereto (U.S. Pat. Nos. 3,783,219 and 2,813,185). This arrangement has as its main disadvantage the need for a separate motor to drive the mode stirrer blades. Additionally, care must be taken to prevent the microwave energy from escaping through the shaft opening to damage or destroy the motor.

Yet another prior art arrangement is shown in U.S. Pat. Nos. 4,019,010; 3,471,671; and 3,991,295, in which the mode stirrer blades themselves are driven by an air stream used to cool the oven magnetron. The advantage of this arrangement is that it does away with the need for a separate motor by utilizing an already present air stream used to cool the magnetron. However, by passing the air stream over the mode stirring blades themselves severe restrictions are placed on the shape and angular orientation of these blades. More specifically, since the blades driven by the air stream also perform the additional function of changing modes within the oven cavity, a compromise blade design which satisfactorily performs both functions, albeit each in a less than optimum manner, must be used. Secondly, this design ordinarily requires the use of an air flow path through the oven cavity itself, and this presents an additional variable to deal with in properly designing the oven by requiring a minimum amount of air circulation to obtain satisfactory mode mixing.

The aforementioned Bale application, Ser. No. 107,003, addresses the above problems and provides for a mode stirrer arrangement wherein the stirrer is driven by means of an air flow which does not impinge on the mode stirring blades themselves. The mode stirrer blades are carried on one end of a rotatable shaft and positioned in the path of microwave energy entering the oven cooking cavity. The other end of the shaft carries a drive fan which is separated from the mode stirrer blades by an air impervious wall and a stream of air is directed onto the drive fan to thereby rotate the shaft and mode stirrer blades. The stream of air onto the drive fan is provided via an air channel which communicates with the magnetron cooling blower.

However, the arrangement of the aforementioned application was found to require a relatively high volume air flow to drive the mode stirrer and resulted in relatively high noise levels during rotation of the mode stirrer assembly.

OBJECTS AND SUMMARY OF THE INVENTION

It is therefore an object of the invention to provide an improved mode stirrer or mode changing arrangement for use in microwave ovens.

A further object is the provision of a mode stirrer drive arrangement which produces relatively low noise level during operation.

A further object is the provision of a mounting arrangement for a mode stirrer which reduces the frictional losses attendant to rotation and thereby permits rotation thereof at an acceptable rate when driven by a relatively small volume air flow.

These and other objects are accomplished by a mode stirrer drive assembly in which the mode stirrer blades are rotated by the force of air against a drive fan. The blades of the drive fan are curved to form convex surfaces which are arranged to face into the flow of air across the drive fan. During rotation an upward force is thereby exerted on the assembly which lifts the assembly off of a thrust bearing and thereby reduces frictional losses and noise and improves performance and efficiency.

BRIEF DESCRIPTION OF THE DRAWINGS

The invention, both as to its organization and the principles of operation, together with further objects and advantages thereof, will best be understood by reference to the following specification taken in conjunction with the accompanying drawings in which.

DESCRIPTION OF THE PREFERRED EMBODIMENT

Figure 1:
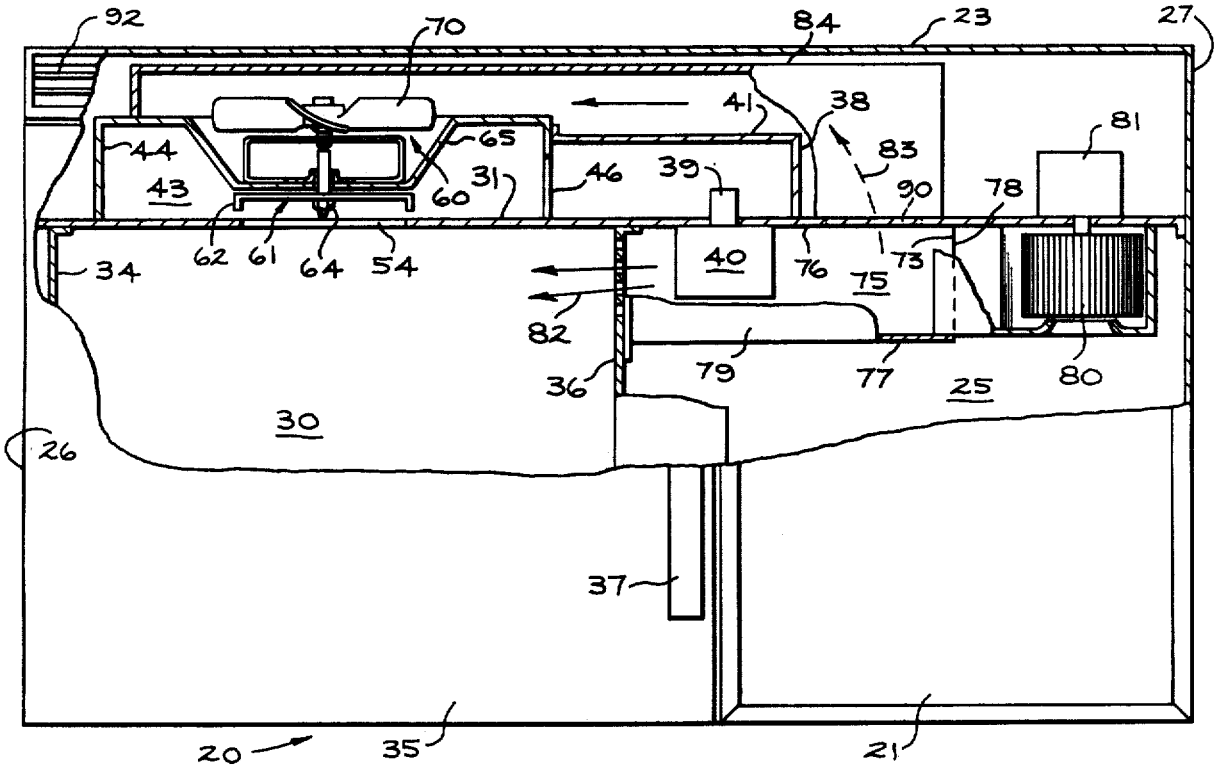
FIG. 1 is a front illustration of an oven embodying the principles of the invention with portions of the oven broken away to show the overall construction of the mode stirrer and the flow of air from the magnetron cooling blower in the electronic component compartment into contact with the mode stirrer drive fan.
Figure 2:
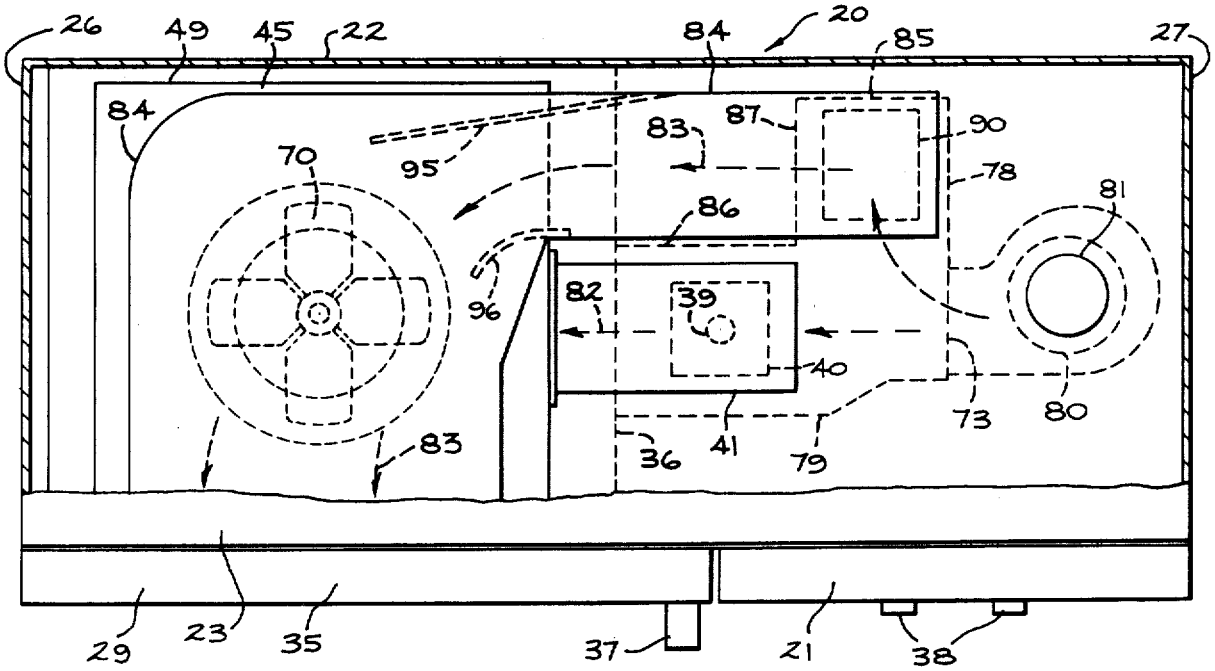
FIG. 2 is an elevational view of the oven of FIG. 1 with the top wall broken away to show the mode stirrer and the air conduits for providing an air stream to drive the mode stirrer.
Figure 3:
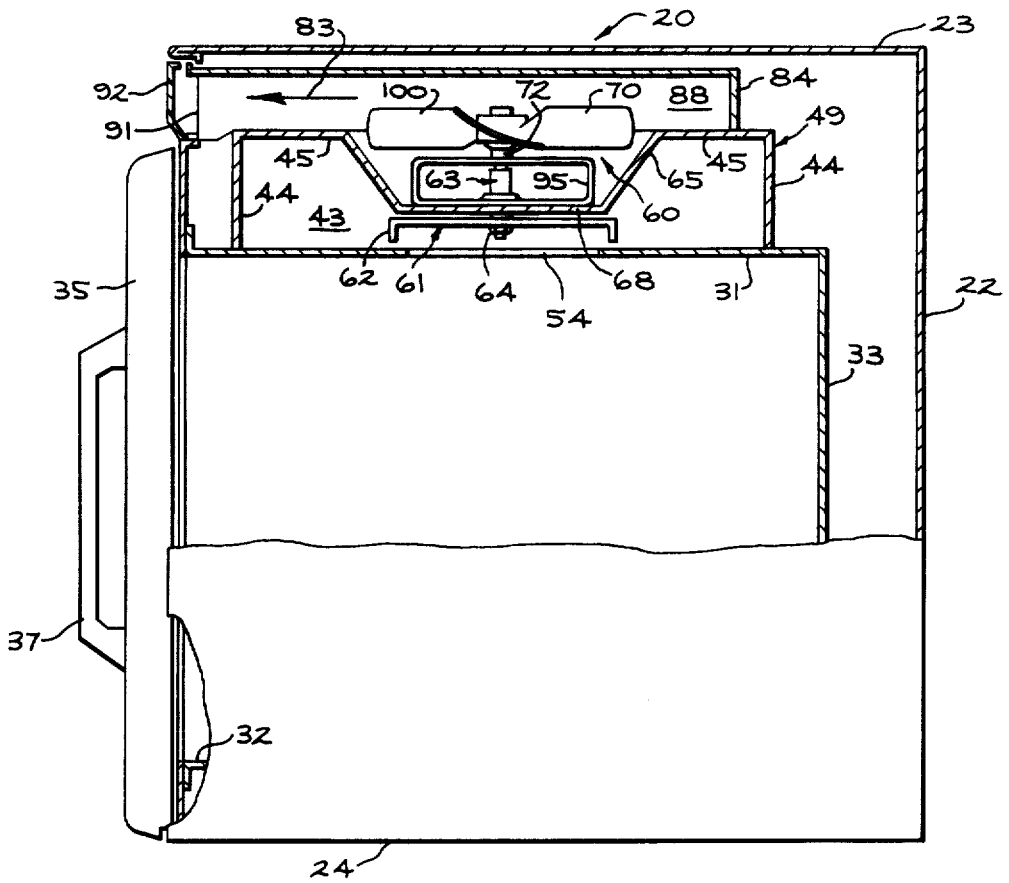
FIG. 3 is a sectional view taken on the line 3—3 of FIG. 2 and showing the details of the mode stirrer assembly and associated air conduits.
Figure 4:
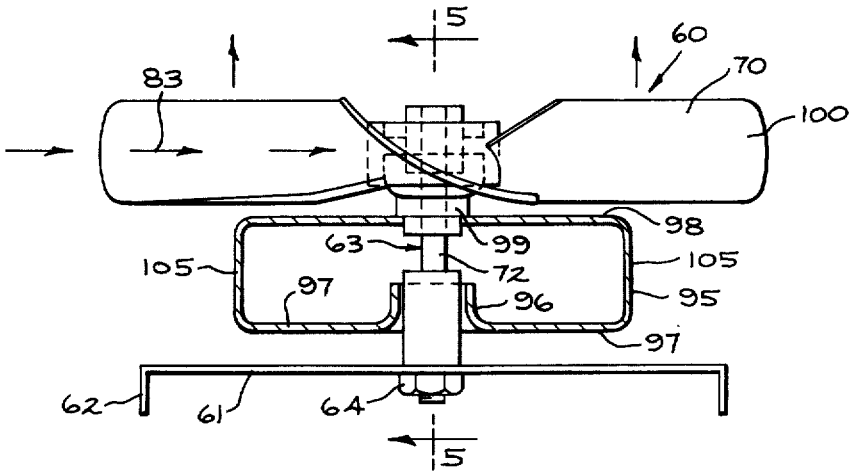
FIG. 4 is an exploded elevational view of the mode stirrer assembly.

Referring now to FIGS. 1-6, there is generally illustrated a microwave oven generally designated by the numeral 20, constructed in accordance and embodying the features of the present invention.

It will be understood that numerous components in addition to those illustrated are required in a complete microwave oven, but for clarity of illustration and brevity of description, only those components believed essential to the understanding of the invention will be described in detail.

The countertop oven 20 is adapted for placement on the top of a table or counter and is housed in a cabinet which includes an upstanding front panel 21, a rear wall 22, a top wall 23, a bottom wall 24, and a pair of opposed sidewalls 26 and 27. Mounted within the oven cavity and alongside the front panel 21 is a heating enclosure or cooking cavity generally designated by the numeral 30, including a top wall 31, a bottom wall 32, a rear wall 33 and a pair of opposed sidewalls 34 and 36.

The front of the heating enclosure 30 is closed by a door 35 which, in the closed position thereof, forms the front wall of the heating enclosure 30, which enclosure is generally in the form of a rectangular parallelepiped. The door 35 inclues a handle 37 and is hinged on the side 29 thereof remote from the handle to allow for easy access to the oven cavity 30. The panel 21 is provided with control knobs 38 for operating the oven. Thus, the interior of the oven cabinet is constructed to include a cooking cavity 30 defined by the walls 31, 32, 33, 34 and 36 within the oven cavity and an electrical control cabinet 25 between the heating enclosure 30 and the oven cabinet walls 22, 23, 24 and 27. The walls 31, 32, 33, 34 and 36, as well as the interior wall of the door 35, are made of a conductive material so as to confine the microwave energy within the inner periphery thereof with a conventional microwave energy seal (not shown) to prevent the escape of microwave energy from the heating enclosure 30 in use.

As indicated hereinbefore, the electrical control compartment 25 includes the various power supply and control circuits for operating the microwave oven including a magnetron 40 which is adapted to produce microwave energy having a frequency of approximately 2450 MHz at the output probe 39 thereof when coupled to a suitable source of power. It should be understood that a suitable high voltage DC power supply (not shown) must be provided to operate the magnetron 40, such power supplies being well known in the art. Microwave energy from magnetron 40 is coupled by the probe 39 into one end of a waveguide 41. A conductive, short-circuiting plate 38 closing off the end of the waveguide 41 is spaced approximately one-sixth wavelength from the probe 39. As is conventional, the waveguide 41 is so dimensioned as to propagate 2450 MHz microwave energy in the $TE_{10}$ mode.

The excitation system of the microwave oven further includes a mode stirrer cavity 43 formed between a cover member 49 and the top wall 31 of the cavity 30. The cover member 49 includes upstanding sidewalls 44 and a top wall 45, the top wall 45 having a rectangular opening 46 therein for connection to the end of the waveguide 41 remote from the probe 39. The mode stirrer cavity 43 has its major dimension oriented horizontally and has a vertical dimension of less than one-half wavelength, and a horizontal extent of a plurality of half wavelengths. The top wall 45 of the cover member 49 includes an indented or depressed portion generally cylindrical in cross section and having a sidewall 65 and base wall 68. The diameter of the conical depression decreases in the direction of the top wall 31. The cavity 43 is substantially square in cross section and is dimensioned to support a plurality of half-waves of standing wave energy in each of the two orthogonal directions. While the illustrated mode stirrer cavity 43 is generally square in cross section, other shapes (for example, circular) may be employed. The waveguide 41 and mode stirrer cavity 43 are generally conventional in design, and more specific information as to their construction may be obtained from U.S. Pat. No. 4,144,436.

The top wall 31 of the cooking cavity 30 is provided with an opening or feed port 54 through which microwave energy is propagated from the mode stirrer cavity 43 into the cooking cavity 30. The feed port 54, while shown as being physically opened, may be closed with any material known in the art to be pervious to microwave energy.

A mode stirrer assembly 60 is supported above the feed port 54. The assembly 60 includes a mode stirrer fan 61, including metal fan blades 62, which are mounted for rotation within the mode stirrer cavity 43 juxtaposed to the entrance port 54. The blades 62 are conventional in design and are shaped to cooperate with the excitation system in effectively changing mode patterns in the oven cavity 30.

A vertically oriented shaft 63 has a lower dielectric section 67 and an upper metal section 72 coupled together in any suitable manner, such as by a pressfit coupling. The mode stirrer fan 61 is mounted on one end of the shaft section 67 by any suitable means, such as a bolt 64 carried on a threaded end of the section 67. The shaft section 67 is made of a non-metal, plastic material having high heat resistance characteristics, preferably Teflon, a synthetic flouride resin.

The upper end of the metal shaft section 72 has attached thereto a drive fan or impeller 70 which projects slightly above the top wall 45 of the mode stirrer cavity. The drive fan 70 may be made of any material, but preferably is constructed of a light plastic so as to minimize the weight of the assembly.

A metal support bracket 95 is attached to the base wall 68 of the mode stirrer cavity and includes an upstanding cylindrical bushing 96 through which the dielectric shaft section 67 passes. The bracket 95 also includes a first horizontal section 97 extending parallel with wall 68, and a second horizontal section 98 spaced vertically thereabove, the wall sections 97 and 98 being coupled together by integral vertical arms 105. The wall section 97 is in intimate electrical contact with the base wall 45 to inhibit the propagation of microwave energy out of the mode stirrer cavity 43. The wall section 98 supports a cylindrical thrust bearing 99 having a central bore and axially aligned with the bushing 96, through which the metal shaft section 72 passes. The uppermost surface 110 (FIGS. 5 and 6) of the bearing 99 serves as a seat upon which the hub of the fan 70 rests when the fan is not rotating. The inner diameter of the central bore in the bearing 99 is selected to only slightly exceed the diameter of the shaft section 72 to vertically align the axis of the shaft section 72.

The outer diameter of the dielectric shaft section 67 is selected to be greater than the interior diameter of the axial bore in bearing 99. Thus, the shaft 63 and its attachments, while captured, are free to move axially to some degree. More specifically and referring to FIGS. 5 and 6, the fan 70, when not rotating, rests in a position (FIG. 5) with the weight thereof supported by contact between the top surface 10 of the bearing 99 and the hub portion of the fan 70. However, the shaft 63 is movable upwardly by a force which overcomes its weight until the upper surface 111 of the shaft section 67 abuts the bottom wall 112 of bearing 99.

The fan 70, as will be described in greater detail hereinafter, includes blades 100 which are specifically designed such that during rotation they supply this upward force to move the shaft 63 vertically thereby reducing friction losses and noise, and permitting a higher rate of revolution of the mode stirrer blades with a minimum of air flow.

Bushing 96 functions to limit the passage of microwave energy from the cavity 43. For this purpose the height and diameter of the bushing are selected to be substantially non-transmissive of microwave energy at the frequency used in the oven. In effect, the bushing 96 is considered as a waveguide filled with a medium having a dielectric constant corresponding to that of the shaft section 67. Tables for determining length and diameter of the bushing to provide an acceptable level of attenuation at the frequency of the microwave energy used are well known in the art.

A blower 80, which may be of the conventional squirrel cage type and driven by a suitable motor 81, is located in the electrical component compartment to provide a cooling air flow over the magnetron 40. For this purpose, the magnetron 40 is positioned in a generally L-shaped main air chamber 75 bounded by an L-shaped extension 76 of the top wall 31 on the top and by a similarly shaped wall section 77 on the bottom. The chamber 75 is further defined on its sides (referring to FIGS. 1 and 2) by walls 79, 78, 85, 86, 87 and 36. The wall 78 is provided with an opening 73 through which a main air stream from blower 80 enters the main air chamber 75, as illustrated generally by the arrows in the drawing. A portion of the air stream directed by the blower 80 toward the magnetron 40 forms a secondary air stream 82 which enters the oven cavity 30 through perforations or openings 84 in the sidewall 36 of the cooking cavity 30. A suitable exit opening (not shown) is also provided in another cavity wall to serve as an exit for the air stream entering through opening 84 to provide a continuous circulation of air through the cooking cavity 30 during the cooking process, as is conventional.

An inlet port 90 is provided in the wall section 76 of the main air chamber 75 and an air directing conduit or duct 84 is provided to create a channel 88 between the top walls of the mode stirrer cavity 43 and the conduit 84. The channel 88 is in air communication with the blower 80 via the chamber 75 and the port 90 and is open at the end thereof remote from the blower 80 at an exit port 91 at the front of the oven (FIG. 3) which is closed by an air pervious grille 92 to thereby provide an air stream 83 along the channel 88.

As can be seen, the drive fan or impeller 70 is located in the air stream 83 intermediate the entrance port 90 and the exit port 91 and a pair of air directing baffles 107 and 108 are positioned in the duct 84 to direct the air stream 83 into the drive fan 70.

Figure 5:
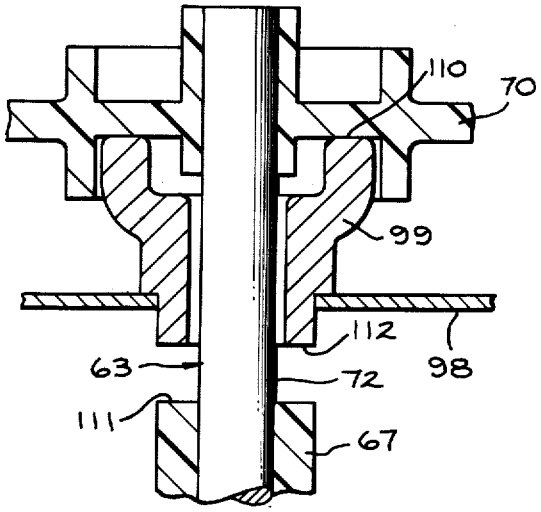
FIGS. 5 and 6 are sectional views of the hub of the drive fan and the bearing on which it is supported when the drive fan is at rest and rotating, respectively, showing the action of the blade in lifting the drive fan off of its bearing support.
Figure 6:
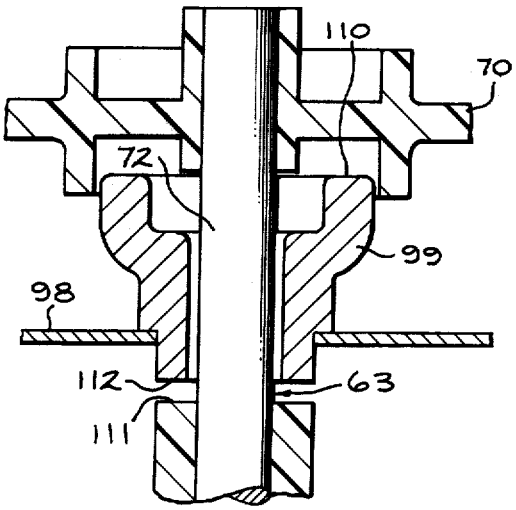

As alluded to earlier, above, the blades 100 of the fan 70 are designed particularly for the purpose of reducing frictional losses and noise during rotation. For this purpose, the blades 100 are curved in cross section and the convex surfaces of the blades are oriented to face the driving air stream 83, FIG. 4. As a result of this the force of the air stream 83 on the blades 100 has a vertical component (upwardly along the axis or shaft 63) which tends to lift the hub of the fan 70 off the seat 110 (FIG. 6) of the bearing 99 during rotation. This action is illustrated in FIGS. 5 and 6 which show the different positions of the fan assembly at rest and during rotation, respectively.

During operation, air from blower 80 operates to cool the magnetron 40 and ventilate the oven cooking cavity 30 by means of air stream 82. Concurrently, the air flow 83 along the channel 88 is directed into contact with the drive fan 70 of the mode stirrer assembly and then out of the oven cabinet via exit port 91. This causes the fan 70 to rotate and consequently the shaft 63 and the mode stirrer blades 62. Since the mode stirrer blades 62 are located in the mode stirrer cavity 43 and are thus separated by the top wall 45 of the cover member 49 from the air stream 83, no air from stream 83 impinges thereon. Also, during operation, the magnetron 40 generates microwave energy which is coupled to the cavity 30 via the waveguide 41 and mode stirrer cavity 43. Since the rotating mode stirrer blades 62 are located in the cavity 43, the field pattern of the microwave energy propagated into the cooking cavity 30 is continuously altered to thereby produce a more uniform distribution of energy and more uniform cooking. In particular, since the convex surfaces of the blades 100 face the oncoming stream 83 the shaft 63 is moved vertically during rotation by the force created by the relatively higher pressure on the underside of the blades 100. This action lifts the hub of the fan 70 from the bearing during rotation.

While a specific embodiment of the invention has been illustrated and described herein, it is realized that numerous modifications and changes will occur to those skilled in the art. For example, while the mode stirrer cavity 43 is illustrated and described as being mounted at the top of the oven cavity, and is further illustrated and described as extending horizontally, it will be apparent that the mode stirrer cavity could be mounted on any outside wall of the cooking cavity 30 without departing from the invention. The mode stirrer assembly in such a construction would be mounted in the same relative position to the mode stirrer cavity and suitable ducting would be utilized to create a stream of air to impinge upon the drive blades of the mode stirrer without impinging on the mode stirrer blades 62.

Since numerous changes may be made in the above described apparatus, and different embodiments of the invention may be made without departing from the spirit thereof, it is intended that all matter contained in the foregoing description or shown in the accompanying drawings shall be interpreted as illustrative and not in a limiting sense.

What is claimed is:

1. A microwave energy stirrer assembly for a microwave oven, said stirrer including stirrer blades mounted for rotational movement in the path of microwave energy into said oven, a vertical mounting shaft, said blades mounted adjacent the lower end of said shaft, a drive fan carried by said shaft adjacent the end remote from said stirrer blades, said stirrer blades adapted when rotated to change the microwave energy field pattern in said oven, air channeling means for directing a flow of air into contact with said drive fan to rotate said fan and consequently said shaft and mode stirrer blades, and a cylindrical bearing for supporting said assembly, said drive fan comprising a plurality of blades having surfaces facing said flow of air, said surfaces being shaped to lift said assembly axially from said bearing during rotation.

2. The combination recited in claim 1 wherein said shaft includes a first dielectric section on which said mode stirrer blades are mounted and a second metal section on which said drive fan is mounted, said bearing arranged to contact said metal section.

3. The combination recited in claim 2 wherein said dielectric shaft has a larger diameter than the inner diameter of said bearing so as to limit upward axial movement of said shaft during rotation.

4. The combination recited in claim 2 wherein said drive fan is made of a plastic material.

5. The combination recited in claim 1 further including an energy stirrer chamber above said oven, said shaft being mounted for rotation in a wall of said chamber, said stirrer blades located for rotation within said chamber.

6. The combination recited in claim 1 wherein said surfaces have convex shape facing said flow of air.

* * * * *